United States Patent [19]

Fainman

[11] Patent Number: 4,920,691

[45] Date of Patent: May 1, 1990

[54] FUEL ADDITIVE

[76] Inventor: Morton Z. Fainman, 11200 Homedale St., Los Angeles, Calif.

[21] Appl. No.: 355,438

[22] Filed: May 22, 1989

[51] Int. Cl.[5] ..... C10L 1/18

[52] U.S. Cl. ..... 44/57; 44/66; 44/70

[58] Field of Search ..... 44/57, 66, 70

[56] References Cited

U.S. PATENT DOCUMENTS

| | | | |
|---|---|---|---|
| 2,236,590 | 4/1941 | Backoff et al. | 44/70 |
| 3,879,176 | 4/1975 | Tsunemi | 44/66 |
| 4,032,303 | 6/1977 | Dorer, Jr. et al. | 44/70 |
| 4,364,743 | 12/1982 | Erner | 44/66 |

*Primary Examiner*—Jacqueline V. Howard

*Attorney, Agent, or Firm*—Spensley Horn Jubas & Lubitz

[57] ABSTRACT

An additive and liquid hydrocarbon fuel composition for use in a reciprocating engine such as a diesel fuel engine, consisting essentially of a fuel and a mixture of two straight chain carboxylic acid esters, one having a low molecular weight and the other having a higher molecular weight, and wherein the additive mixture increases the efficiency of the engine and decreases pollution.

10 Claims, No Drawings

FUEL ADDITIVE

FIELD OF INVENTION

This invention relates to additives for liquid fuels, and more particularly, to an additive for diesel fuel which improves the performance, fuel efficiency and control of emissions of a vehicle using the fuel.

PRIOR ART

The use of additives in lubricating oils has lead to a marked improvement in performance and reliability of vehicles powered by internal combustion engines using gasoline and diesel fuel. The development of such additives has lead to a better understanding of their performance and has lead to a sophisticated design of chemicals to improve the many functions required of lubricating oils. To protect the lubricant, the prior art added antioxidants and metal deactivators. To help ensure proper performance of the lubricant, there are pour point depressants, seal swell agents, antifoam agents and viscosity index improvers. To help ensure proper performance of the engine, yet other additives have been used such as antiwear agents, corrosion and rust inhibitors, detergents, dispersants and friction modifiers.

The past and expected future shortages of petroleum-derived fuels has lent impetus to the development of fuel-efficient engine oils using less viscous base stocks with polymers as thickening agents as well as friction modifiers to improve efficiency. The above-described methods of improving fuel efficiency by additions of various agents to the lubricating oil can also be used in conjunction with each other. However, the improvements in fuel efficiency are rather modest, and are difficult to ascertain without laborious statistical testing in fleets of vehicles.

The development of additives for fuel has drawn heavily on those developed for lubricating oils, but with a somewhat different emphasis. To protect the fuel, the prior art has added antioxidants, metal deactivators and demulsifiers. Performance additives include antiknock agents for gasoline engines and ignition improvers for diesel engines, detergents, dispersants, mineral oil as an upper cylinder lubricant, corrosion inhibitors and pour point depressants for diesel fuel.

One composition which has been added to gasoline and diesel fuel in order to improve upper cylinder lubrication and the cleaning ability of the fuel included the combination of an oil soluble dispersant/detergent and a mineral lubricating oil. However, for such a composition there has been no significant changes noticed in the fuel efficiency or performance of engines using such fuel as a result of the addition of such additives.

Examples of certain compounds which have been used as additives can be found in U.S. Pat. Nos. 1,692,784; 2,086,589; and 2,527,889. See also "Fuel Additives For Internal Combustion Engines," M.W. Ranney, Noyes Data Corporation, Park Ridge, N.J., 1978, Chemical Technology Review No. 112., "Chemical Additives For Fuels" M.T. Gillies, Noyes Data Corporation, Park Ridge, N.J., 1982, Chemical Technology Review No. 203. Further, while it has been noted that certain additives may possess desirable qualities with respect to performance, the problem of increasing mileage and reducing emissions and pollutants, including reduction of black smoke associated with many diesel engines, has gone unsolved.

It is therefore a purpose of the present invention to provide a composition and method of using the same, which not only increases mileage, but also deals with the other problems noted above.

BRIEF SUMMARY OF THE INVENTION

It is an object of the present invention to provide an additive for diesel fuels which will result in improved fuel efficiency and performance of the engine.

It is a further objection of the present invention to provide a fuel additive which is economical to use and which may be added in small quantities, but which is effective in producing the desired results.

It is yet a further object of the present invention to provide a fuel additive which not only improves fuel efficiency, but also helps reduce emissions and pollution including the formation of black smoke commonly associated with diesel engines.

In a reciprocating engine which uses liquid, organic fuel, a small amount of friction occurs in the fuel pump, injectors, etc., but the primary source of mechanical friction occurs between the piston rings and the cylinder walls. Lubrication in this area ranges from predominantly hydrodynamic to boundary. Friction in the boundary region, particularly where the piston reverses direction, can be appreciable.

Straight chain organic acid with at least 6 carbon atoms may be used as boundary lubricants. There is no upper limit to the number of carbon atoms, but practicality associated with solubility in fuel and the like would suggest a limit of 16 carbon atoms. Esters of such acids retain these boundary lubricant properties and provide a wide choice of very desirable physical properties for use as an additive. The efficiency of these acid depends on the polar carboxyl group reacting with the metal surface to form a high melting metal soap. In the presence of hydrocarbon oils, the acid moiety of the soap forms a tenacious lubricant film of increased viscosity to reduce friction in the boundary region.

Past experience has indicated that the large concentration of a detergent/dispersant in modern lubricating oils, suggested as additives to fuels as described above, may interfere with the chemisorbed layer reducing its effectiveness. It has been discovered that by introducing the high molecular weight straight chain organic acid or related ester directly into the fuel, particularly in a diesel engine, in small quantities and without the presence of a dispersant, effects on performance are noticeable after just 1,000 to 3,000 miles of operation. Vibration is reduced. Further, the engine at idle runs more smoothly and quietly. Acceleration improves as well as power. Also, fuel efficiency is improved. Relatively small amounts of a conventional detergent or dispersant when used in conjunction with the acids or esters described above do not interfere with the performance of these materials.

Examples of high molecular weight carboxylic acids or esters thereof which may be used as the additive of the present invention are oleic acid, stearic acid, palmitic acid, pelargonic acid, hexanoic acid, dodecyl pelargonate, sorbitan monoleate, isopropyl palmitate and butyl stearate.

While not to be bound by any theory, it is believed that these high molecular weight straight-chain carboxylic acid esters survive the combustion in the cylinder and are available to react with the rings and cylinder walls. As noted above, this additive forms a metal soap which provides lubrication in the boundary friction region and is a great improvement over the conventional mineral oil-based overhead lubricant.

Tests of low molecular weight esters such as methyl laureate (M.W. 214) showed no increase in efficiency of a diesel powered vehicle. On the other hand, dipentaerythritol hexalkanoate in which the acid moiety contained a mix of $C_5$ and $C_{10}$ acids (M.W. 927) showed an increase in efficiency of 5%. Both esters benefit emissions.

An analysis of the data suggests that the low molecular weight esters act as a solvent, cleaning the injectors and as a boundary lubricant in the cool portion of the fuel feed system. The high molecular weight ester, acting as a synthetic overhead lubricant, partially survives the combustion and contributes an acid moiety to form the chemisorbed iron soap to provide boundary lubrication.

It has been discovered that by introducing a mixture of a low molecular weight ester of a straight chain organic carboxylic acid together with a similar, but high molecular weight ester into the fuel, particularly in a diesel engine, in small quantities and without the presence of a dispersant, readily observable effects on performance are noticeable after 1,000 to 3,000 miles of operation. Vibration is reduced and the engine at idle runs more smoothly and quietly. Smoking is reduced markedly and power, acceleration and fuel efficiency are improved. Of particular significance is that engine efficiency is improved in new vehicles and emissions of pollutants in the exhaust gases are most often reduced.

Although straight chain carboxylic acids may be used as an additive to impart boundary lubricant properties to a liquid organic fuel, it is necessary to use a mixture of esters each containing an appropriate acid moiety coupled with a alcohol or polyhydric alcohol to obtain a fuel additive with the required physical properties. Namely, a low molecular weight ester as a solvent and a high molecular weight ester to survive the combustion and react with the iron surfaces to provide boundary lubrication.

Examples of acids which may be used to provide esters for use as additives in the present invention are hexanoic acid, pelagonic acid, lauric acid, palmitic acid, oleic acid and stearic acid. Examples of alcohols to be used for esterification are methanol, ethanol and propanol. Examples of polyhydric alcohols are neopentyl glycol, trimethylol ethane, trimethylolpropane, pentaerythritol and sorbitol. The high molecular weight esters are also illustrated and discussed in an article written by R.S. Barnes and M.Z. Fainman, *Synthetic Ester Lubricants*, Lubrication Engineering, Vol. 13, p.454ff, 1957, and in *Synthethic Lubricants*, by Hart et al. 1962, Chap. 10 Neopentyl Polyol Esters, pgs. 388-401, both herein incorporated by reference.

The use of low molecular weight esters alone has not been found to be effective with respect to improving fuel efficiency. In the present invention, however, the above-referenced low molecular materials (used as a solvent to minimize injector deposits) are mixed with high molecular weight materials of which a portion will survive the combustion. It is theorized that the low molecular weight materials similar in molecular weight to octane and cetane, are burned completely along with the diesel fuel. In other words, they are not available for reaction with rings and cylinder walls to form a boundary lubricant layer. These low molecular weight materials, however, act as solvents and keep the injectors clean. This eliminates the need for other dispersants, and thus help reduce pollutants.

High molecular weight esters, particularly those with a neopentylpolyol structures, are very stable and a portion would be expected to survive the combustion and be available to form the boundary lubricant layer. By the use of a mixture of the high and low molecular weight esters, the need for a dispersant is eliminated. The reason that the elimination of the dispersant is desirable is that many contain sulfur or nitrogen. This leads to the formation of sulfur oxides and nitrogen oxides upon combustion, both undesirable pollutants. The high and low molecular weight materials used in the present invention are composed only of carbon, hydrogen and oxygen, and thus pollution is minimized.

The novel features which are believed to be characteristic of the present invention, both as to its composition, and method of use, together with further objectives and advantages thereof, can be better understood from the following description in which presently preferred embodiments of the invention are illustrated by way of examples. It is to be expressly understood, however, that the examples are for purposes of illustration only, and are not intended as a definition of the limits of the invention.

DETAILED DESCRIPTION OF THE INVENTION

The fuel additive of the present invention is particularly suited for use with diesel fuels, although it is contemplated that it may be used with other liquid fuels (gasoline or alcohols) with similar results.

The fuel additive of the present invention consists essentially of a mixture of a low molecular weight straight chain carboxylic acid ester with a carbon chain of from 6 to 12 carbon atoms, and with a total molecular weight of less than 200 and preferably in the range of 125 to 200 hereinafter referred to herein as component "A"; and a high molecular weight straight chain carboxylic acid ester with molecular weight of from about 300 to 1,000. The high molecular weight ester is referred to herein as component "B".

These compounds, (A&B) may be added alone or in combination with other additives, although it is preferred not to include any additive which would increase pollution. Typically, the mixture of high and low molecular weight materials are added as part of an oil-base carrier. The carrier also aids in lubrication in that it is believed that it becomes more viscous and firmly bound to the metal surface by means of the iron-soap. The total concentration of the additive mixture (A+B) is preferably about 100 parts per million to about 1,000 parts per million of the fuel. Higher concentrations are feasible, but not generally economic. Obviously, the liquid fuel is the major ingredient.

There are many compounds known in the art and available commercially which may be utilized in the present invention. Example of such compounds are methyloctanoate, methyllaurate, trimethylolpropane trilaurate, pentaeythritol tetralaurate and dipentaerythritol hexaheptanoate (acids are $C_5$–$C_{10}$, average $C_7$)

All of these compounds are currently commercially available.

The addition of any of the above compounds, to diesel fuel or gasoline, alone or in combination, in concentrations from about 100 to 1,000 parts per million has yielded surprising and unexpected results. Dipentaerythritol hexapentanoate (acid $C_5$–$C_{10}$, average $C_7$) when added to conventional diesel fuel and used in a new engine, showed significant improvements in vibration, power, acceleration and fuel efficiency. Methyllaurate when tested in a similar manner showed no improvement.

bustion to be effective as a boundary lubricant on the rings and cylinder walls.

Set forth below are the vehicles and test methods utilized in obtaining the data shown in the following tables and charts.

EFFECT OF ADDITIVES ON FUEL ECONOMY AND EMISSIONS

| ADDITIVE | FUEL/ VEHICLE | FUEL ECONOMY MILES/ GALLON | HYDRO-CARBONS GRAMS/MILE | PERCENT CHANGE EFFECTED BY ADDITIVE: CARBON MONOXIDE/ GRAMS/MILE | NITROGEN OXIDES GRAMS/MILE | PARTIC-ULATES GRAMS/MILE |
|---|---|---|---|---|---|---|
| 50% DIPENTAERYTH-RITOL HEXAALKANO-ATE (ACID $C_5$-$C_{10}$) | Texaco #2 Diesel | | | | | |
| 50% 100 NEUTRAL OIL | Peugeot | +5 | −66 | −32 | −4 | −10 |
| 50% METHYL-LAURATE + | EPA Reference | | | | | |
| 50% 100 NEUTRAL OIL | Diesel Fuel | | | | | |
| | Ford | −3 | −21 | −3 | +1 | −14 |
| 25% METHYLLAURATE | Chevron | | | | | |
| 25% PENTAERYTH-RITOL-TETRALAURATE | Regular No Lead | | | | | |
| 50% 100 NEUTRAL OIL (D-1280X) | Mercedes | +16 | −42 | +78 | −23 | — |

VARNISH TEST TABLE

| Ester | Number of Carbon Atoms In Acid Moiety/Molecule | Appearance Of Varnish After Test | Estimated Amount Of Varnish Remaining: By Scraping | Wrinkle | Comments |
|---|---|---|---|---|---|
| Methyl caprylate/ caprate | $C_8$ to $C_{10}C_{10}$ | Peeled | None | None | Peeled at room temp. in 1 hour. |
| Methylaurate | $C_{12}/C_{13}$ | Soft | Very Slight | Trace | |
| Methylmyristate | $C_{14}/C_{15}$ | Hard | Medium | Medium | |
| Methylpalmitate | $C_{16}C_{17}$ | Hard | Medium | Medium | |
| Methylstearate | $C_{18}/C_{19}$ | Soft | Heavy | Heavy | |
| Methyloleate | $C_{18}/C_{19}$ | Soft | Heavy | Heavy | |
| Methylbehenate | $C_{22}C_{23}$ | Hard | Heavy | Heavy | |
| *TMP tri-caprylate/caprate | $C_8$ to $C_{10}/C_{32}$ | Hard | Heavy | Heavy | |
| *TMP trilaurate | $C_{12}/C_{41}$ | Hard | Heavy | Heavy | |
| .PE tetra-Caprylate/caprate | $C_5$ to $C_{10}/C_{41}$ | Hard | Heavy | Heavy | |
| .PE tetra laurate | $C_{12}/C_{53}$ | Hard | Heavy | Heavy | |
| .PE tetra-Palmitate | $C_{16}/C_{69}$ | Hard | Heavy | Heavy | |
| .PE tetra-oleate | $C_{18}C_{77}$ | Hard | Heavy | Heavy | |
| Cetyl palmitate- | $C_{16}/C_{26}$ | Hard | Heavy | Heavy | Varnish easily scraped off |

*TMP is trimethylolpropane
.PE is pentaerythritol

A simple test was designed (see below) using a marine spar varnish to simulate the effect of additives on deposits. The results indicated that esters of low molecular weight which parallel those of octane and cetane do remove the varnish film. These low molecular weight materials are excellent solvents as well as fuels and apparently clean and lubricate the fuel injectors up to the cylinder. As a good fuel they apparently do not survive the combustion and are therefore not available to react with the rubbing surface of the rings against the cylinder walls.

The high molecular weight esters on the other hand do not attack the varnish film, but like other high molecular weight additives, do partially survive the com-

EFFECT OF CONCENTRATION ON VARNISH REMOVAL

| ESTER | PERCENT | APPEARANCE OF VARNISH AFTER 24 HOURS |
|---|---|---|
| A | 10 | Hard |
| B | 90 | |
| A | 30 | Hard |
| B | 70 | |
| A | 50 | Soft |
| B | 50 | |
| A | 75 | Soft |
| B | 25 | |
| A | 100 | Removed in 1 hr. |

-continued

| EFFECT OF CONCENTRATION ON VARNISH REMOVAL | | |
|---|---|---|
| ESTER | PERCENT | APPEARANCE OF VARNISH AFTER 24 HOURS |
| B | 0 | |

ESTERS:
A = Methylcaprylate/caprate with an average of C9 in the acid moiety and $C_{10}$ total.
B = Pentaerythritol/tetralaurate with $C_{12}$ in the acid moiety and $C_{53}$ total.

SUMMARY OF TEST OF EFFECT OF DIESEL FUEL CONDITIONER D-1280X ON EXHAUST SMOKE OPACITY OF LAX SHUTTLE BUSES

From June 1988 to April 1989, thirty shuttle buses at Los Angeles International Airport (LAX) were tested to determine the effect of Diesel Fuel Conditioner D-1280X on exhaust smoke opacity.

FORECASTED RESULTS OF TESTING ALL BUSES IN FLEET

SUMMARY OF TEST PROCEDURE

TEST METHODOLOGY: A Wager Model 650 Smoke Opacity Meter was used. It gives a direct readout of exhaust smoke opacity, in percent. For each bus, the State of New Jersey Smoke Opacity Testing Procedure 7:278B-4.4 for Diesel-Powered Autobuses was conducted three times, and the results averaged (see next page). Each test involved sudden acceleration from rapid idle (1200-1300 rpm) to maximum regulated rpm, with peak opacity recorded.

BASELINE TESTS: Baseline (no conditioner) tests were conducted from June 23, 1988 to July 14, 1988.

CONDITIONER ADDED: After Baseline tests, Diesel Fuel Conditioner D-1280X was added to diesel fuel #2 used by all buses in the ratio 1:1280 (1 gallon D-1280X to 1,280 gallons of fuel).

TWO MONTHS AFTER BASELINE: During the period Aug. 18, 1988 to Sep. 1, 1988, after the buses had used D-1280X for an average of 4,311 miles, the same New Jersey tests were repeated.

TEN MONTHS AFTER BASELINE: During the period April 13–21, 1989, after the buses had been using D-1280X for an average of 26,103 miles, the final tests were conducted.

| FORCASTED RESULTS OF TESTING ALL BUSES IN FLEET | | | | | |
|---|---|---|---|---|---|
| | | | | PERCENT REDUCTION IN AVERAGE OPACITY | |
| SAMPLE GROUP | BASELINE OPACITY | AVERAGE MILES USING D-1280X | CONFIDENCE LEVEL | FROM | TO |
| ALL 30 BUSES | 6 to 75% | 26,103 | 95% | 48% | 77% |
| HEAVY SMOKERS (11 buses) | >31% | 4,311 | 80% | 10% | 53% |
| | | 26,103 | 95% | 68% | 84% |
| LIGHT SMOKERS (19 buses) | <24% | 26,103 | 95% | 20% | 59% |

TEST OF EFFECT OF DIESEL FUEL CONDITIONER D-1280X ON EXHAUST SMOKE OPACITY OF LAX SHUTTLE BUSES

| | BASELINE (NO COND) (6/23/88–7/14/88) | | | | | FIRST TEST WITH CONDITIONER (8/18/88–9/1/88) | | | | | | | SECOND TEST WITH CONDITIONER (4/13/89–4/21/89) | | | | | | |
|---|---|---|---|---|---|---|---|---|---|---|---|---|---|---|---|---|---|---|---|
| VEH | DATA | | | | | | MILES | DATA | | | | CHANGE | | MILES | DATA | | | | CHANGE |
| I.D. | 1 | 2 | 3 | AVE | ODOMTR | ODOMTR | TRAVLD | 1 | 2 | 3 | AVE | IN % | ODOMTR | TRAVLD | 1 | 2 | 3 | AVE | IN % |
| 40 | 62 | 59 | 44 | 55.0 | 238809 | 244483 | 5674 | 50 | 49 | 49 | 49.3 | −10.3 | 263386 | 24577 | 12 | 12 | 12 | 12.0 | −78.2 |
| 41 | 17 | 17 | 16 | 16.7 | 277215 | 280627 | 3412 | 16 | 16 | 15 | 15.7 | −6.0 | 301573 | 24358 | 10 | 10 | 10 | 10.0 | −40.0 |
| 42 | 17 | 16 | 15 | 16.0 | 251435 | 255030 | 3595 | 11 | 10 | 9 | 10.0 | −37.5 | 281329 | 29894 | 10 | 10 | 9 | 9.7 | −39.6 |
| 43 | 14 | 14 | 14 | 14.0 | 234028 | 238398 | 4370 | 14 | 13 | 11 | 12.7 | −9.5 | 266380 | 32352 | 9 | 9 | 9 | 9.0 | −35.7 |
| 44 | 35 | 35 | 31 | 33.7 | 256127 | 260462 | 4335 | 18 | 19 | 20 | 19.0 | −43.6 | 290083 | 33956 | 9 | 9 | 9 | 9.0 | −73.3 |
| 45 | 13 | 14 | 14 | 13.7 | 230727 | 231779 | 1052 | 9 | 9 | 9 | 9.0 | −34.1 | 263631 | 32904 | 10 | 9 | 9 | 9.3 | −31.7 |
| 46 | 56 | 56 | 57 | 56.3 | 267529 | 272611 | 5082 | 51 | 50 | 50 | 50.3 | −10.7 | 296358 | 28829 | 9 | 9 | 8 | 8.7 | −84.6 |
| 47 | 36 | 31 | 33 | 33.3 | 253826 | 259609 | 5783 | 29 | 29 | 29 | 29.0 | −13.0 | 279399 | 25573 | 14 | 13 | 14 | 13.7 | −59.0 |
| 48 | 65 | 64 | 62 | 63.7 | 255832 | 261667 | 5835 | 55 | 53 | 52 | 53.3 | −16.2 | 282177 | 26345 | 10 | 9 | 8 | 9.0 | −85.9 |
| 49 | 29 | 34 | 32 | 31.7 | 196056 | 200479 | 4423 | 19 | 19 | 18 | 18.7 | −41.1 | 224833 | 28777 | 14 | 13 | 12 | 13.0 | −58.9 |
| 50 | 23 | 23 | 23 | 23.0 | 285333 | 289676 | 4343 | 21 | 20 | 21 | 20.7 | −10.1 | 321476 | 36143 | 10 | 9 | 9 | 9.3 | −59.4 |
| 51 | 10 | 9 | 10 | 9.7 | 248068 | 250602 | 2534 | 3 | 3 | 1 | 2.3 | −75.9 | 270357 | 22289 | 4 | 3 | 2 | 3.0 | −69.0 |
| 52 | 17 | 19 | 18 | 18.0 | 243203 | NOT AVAILABLE AT TEST TIME | | | | | | | 270229 | 27026 | 9 | | 9 | 9.0 | −50.0 |
| 53 | 14 | 14 | 14 | 14.0 | 254958 | 259043 | 4085 | 10 | 9 | 9 | 9.3 | −33.3 | 285550 | 30592 | 8 | 8 | 8 | 8.0 | −42.9 |
| 54 | 15 | 15 | 15 | 15.0 | 251192 | 254100 | 2908 | 14 | 15 | 14 | 14.3 | −4.4 | 277464 | 26272 | 8 | 8 | 7 | 7.7 | −48.9 |
| 55 | 75 | 76 | 75 | 75.3 | 129566 | 133738 | 4172 | 46 | 46 | 45 | 457 | −39.4 | 151294 | 21728 | 10 | 9 | 8 | 9.0 | −88.1 |
| 56 | 7 | 7 | 5 | 6.3 | 264683 | BAD ODOM. | | 6 | 6 | 6 | 6.0 | −5.3 | BAD ODOM. | | 6 | 5 | 6 | 5.7 | −10.5 |
| 57 | 7 | 6 | 6 | 6.3 | 192064 | 198935 | 6871 | 5 | 6 | 5 | 5.3 | −15.8 | 215381 | 23317 | 5 | 5 | 5 | 5.0 | −21.1 |
| 58 | 15 | 14 | 14 | 14.3 | 274784 | 279613 | 4829 | 13 | 12 | 12 | 12.3 | −14.0 | 311558 | 36774 | 12 | 12 | 12 | 12.0 | −16.3 |
| 60 | 13 | 13 | 12 | 12.7 | 163645 | 170064 | 6419 | 9 | 8 | 9 | 8.7 | −31.6 | 199082 | 35437 | 9 | 8 | 9 | 8.3 | −34.2 |
| 61 | 36 | 32 | 34 | 34.0 | 250156 | 250599 | 443 | 15 | 15 | 13 | 14.3 | −57.8 | 259574 | 9418 | 14 | 13 | 13 | 13.3 | −60.8 |
| 62 | 9 | 9 | 9 | 9.0 | 207332 | NOT AVAILABLE AT TEST TIME | | | | | | | 226296 | 18964 | 6 | 5 | 4 | 14.0 | −44.4 |
| 63 | 48 | 48 | 48 | 48.0 | 170807 | NEW ODOM. | | 26 | 24 | 23 | 24.3 | −49.3 | 26712 | 26712 | 15 | 14 | 13 | 5.0 | −70.8 |
| 65 | 23 | 24 | 23 | 23.3 | 229915 | 231745 | 1830 | 21 | 21 | 20 | 20.7 | −11.4 | 246375 | 16460 | 13 | 12 | 12 | 12.3 | −47.1 |
| 66 | 9 | 9 | 8 | 8.7 | 269301 | 273912 | 4611 | 7 | 5 | 5 | 5.7 | −34.6 | 297981 | 28680 | 5 | 5 | 5 | 5.0 | −42.3 |
| 67 | 24 | 23 | 20 | 22.3 | 251180 | 254916 | 3736 | 22 | 21 | 20 | 21.0 | −6.0 | 273769 | 22589 | 10 | 9 | 9 | 9.3 | −58.2 |
| 68 | 66 | 65 | 66 | 65.7 | 39746 | NOT AVAILABLE AT TEST TIME | | | | | | | 52804 | 13058 | 11 | 10 | 9 | 10.0 | −84.8 |
| 69 | 13 | 13 | 12 | 12.7 | 161219 | 167486 | 6267 | 10 | 10 | 10 | 10.0 | −21.1 | 174148 | 12929 | 8 | 8 | 8 | 8.0 | −36.8 |
| 70 | 8 | 8 | 8 | 8.0 | 298589 | | | 6 | 6 | 6 | 6.0 | −25.0 | 322637 | 24048 | 5 | 5 | 4 | 4.7 | −41.7 |
| 71 | 54 | 52 | 53 | 53.0 | 165620 | 172473 | 6853 | 25 | 25 | 23 | 24.3 | −54.1 | 202592 | 36972 | 9 | 9 | 9 | 9.0 | −83.0 |
| | AVERAGES: | | | 27.1 | | | 4311 | | | | 19.2 | −29.2 | | 26103 | | | | 9.0 | −66.7 |
| | | | | AVERAGE OPACITY PERCENT (X1ave) | | | MILES WITH D-1280X | | | | AVERAGE OPACITY PERCENT (X2ave) | PERCENT REDUCTION IN AVERAGE OPACITY | | MILES WITH D-1280X | | | | AVERAGE OPACITY PERCENT (X3ave) | PERCENT REDUCTION IN AVERAGE OPACITY |

TEST CONDUCTED: New Jersey Department of Environmental Protection Smoke Opacity Testing Procedure 7:27B-4.4 for Diesel-Powered Autobuses
TEST INSTRUMENT: Wager Model 650 Smoke Opacity Meter
TEST CONDUCTED BY: Maintenance Services
MIXTURE RATIO: 1 part D-1280X to 1,280 parts of diesel fuel (1 ounce in 10 gallons) (1 gallon in 1,280 gallons)

Vehicles

1. Peugeot: 1981, Model 505S Turbo Diesel, 4 cylinder. No emission controls.
2. Mercedes Benz: 1984, Model 380 SL (Gasoline), 8 cylinder. Equipped with emission controls.
3. Ford: 1987, Model P/U F-250, diesel, 8 cylinder. No emission control.

Test Methods and Vehicles to Evaluate Additives

The Peugeot and Mercedes vehicles were driven about 2,500 miles in normal use and were then transferred to a dynamometer. Fuel efficiency and emissions were determined using the EPA City cycle in the 505 transient hot start test. Runs were made with and without the additive. The additive was used in a amount of 1 ounce per 10 gallons of fuel.

The Ford was operated on a prescribed course of about 40 miles (part city, party freeway) for 1,500 miles and then tested using the procedures prescribed by the U.S. Environmental Protection Agency. The EPA City Cycle Test, cold start (CFR 86.235-79) results were used with and without the additive.

Varnish Test Used to Simulate Engine Deposits

The test specimens were prepared from 1" screw cap inserts sprayed on top with varnish. These were allowed to dry for at least a week prior to use. A coated specimen was placed in a 2-ounce jar, varnish side up, and 10 grams of ester were added. A aluminum foil lined cover was partially screwed on and the container was placed in an oven at 200° F. When at temperature, the cover was tightened and heating continued for 72 hours, examining samples after the first hour, then at 9:00 a.m. and 5:00 p.m. the days following. Upon completion the coating was examined for resistance to the ester by scratching with a metal probe for firmness and adherence and by coating with a carburetor cleaner to induce wrinkling which indicated the uniformity and amount of coating remaining.

As can be seen from the above tables and charts the use of low and high molecular weight esters improve both fuel efficiency and reduction of pollution.

Thus, pursuant to the present invention, it is possible to use as an additive, a combination of high and low molecular weight straight chain organic acid esters with a carbon chain of from 6 to 18 carbon atoms in diesel fuel to greatly improve performance.

Since beneficial results may be obtained from the use of even small amounts of the additive of the present invention, its use will add little to the cost of the fuel.

It is apparent from the wide variety of compounds actually tested that the present invention should not be limited merely to those specific examples discussed herein. Rather, the above tests indicate that a wide variety of straight chain acid esters may be utilized as the additive mixture pursuant to the present invention. Thus, the claims should not be limited except by what is consistent with the prior art.

I claim:

1. A liquid hydrocarbon fuel and additive composition for use in a reciprocating liquid fuel engine, the additive being present in an amount sufficient to increase engine performance and reduce smoke emissions, from about 100 to 1,000 parts per million by volume of said fuel and consisting essentially of a mixture of:

(a) from 10 to 90 wt.% of the additive being a straight-chain carboxylic acid ester having a molecular weight of about 125 to 200; and (b) from about 90 to 10 wt.% of a combustion-survivable neopentylpolyol ester of a straight-chain carboxylic acid, having a molecular weight of from about 300 to 1000.

2. The liquid fuel and additive composition according to claim 1, wherein said ester (a) has from 6 to 12 carbon atoms in the acid moiety.

3. The liquid fuel and additive composition according to claim 1, wherein said ester (a) is methyllaurate.

4. The liquid fuel and additive composition according to claim 3, wherein said ester (b) is pentaerythritol tetralaurate.

5. The liquid fuel and additive composition according to claim 1, wherein said mixture (A+B) is dissolved in an oil-based carrier.

6. The liquid fuel and additive composition according to claim 5 wherein the carrier is present,in an amount of from 25 to 75% by volume of the additive.

7. A diesel fuel and additive composition for improving engine efficiency and reducing smoke emission, the composition consisting essentially of:

(a) a major proportion of diesel fuel; and (b) from about 100 to 1000 parts per million of a mixture of: (i) a high molecular weight combustion-survivable neopentylpolyol ester of a straight chain carboxylic acid and (ii) a low molecular weight, from about 125 to 200, straight chain carboxylic acid ester, said mixture of esters being dissolved in an oil-based carrier.

8. The fuel and additive composition of claim 7 wherein the ratio of high molecular weight esters to low molecular weight esters is from about 70 to 30 wt.% 30 to 70 wt.%.

9. A method for increasing the performance and reducing pollutants in an internal combustion engine, comprising of the steps of:

(a) forming a composition of a liquid hydrocarbon fuel and an additive mixture, said mixture consisting essentially of (i) a combustion-survivable neopentylpolyol ester of a straight chain carboxylic acid having a molecular weight from about 300 to 1,000, and (ii) a straight chain carboxylic acid ester having a molecular weight of from about 125 to 200, the mixture being present within the range of from about 100 to 1,000 parts per million by volume of said fuel; and (b) using said mixture as a fuel in said internal combustion engine.

10. The method of claim 9 wherein the additive mixture is dissolved in an oil-based carrier.

* * * * *